US009627831B1

(12) United States Patent
Wagman et al.

(10) Patent No.: US 9,627,831 B1
(45) Date of Patent: Apr. 18, 2017

(54) ROTATING CONTACT RING WITH LEGS EXTENDING AT AN ANGLE TO A LOWER SURFACE OF THE RING

(71) Applicant: Apple Inc., Cupertino, CA (US)

(72) Inventors: Daniel C. Wagman, Los Gatos, CA (US); Michael B. Wittenberg, Sunnyvale, CA (US); Eric T. SooHoo, Sunnyvale, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 15/077,730

(22) Filed: Mar. 22, 2016

Related U.S. Application Data

(60) Provisional application No. 62/235,508, filed on Sep. 30, 2015.

(51) Int. Cl.
*H01R 39/00* (2006.01)
*H01R 35/04* (2006.01)

(52) U.S. Cl.
CPC ..... *H01R 35/04* (2013.01); *H01R 39/00* (2013.01)

(58) Field of Classification Search
CPC ..... H01R 35/04; H01R 39/00; H01R 39/64
USPC ..... 439/13–30
See application file for complete search history.

(56) References Cited

U.S. PATENT DOCUMENTS

| | | | | | |
|---|---|---|---|---|---|
| 2,134,355 | A * | 10/1938 | Caldwell | H01R 31/00 | 337/216 |
| 2,471,957 | A * | 5/1949 | Hubbard | H01R 4/32 | 24/136 R |
| 2,477,901 | A * | 8/1949 | Robboy | H01R 39/64 | 174/86 |
| 3,092,695 | A * | 6/1963 | Abrams | F21S 8/035 | 200/51 R |
| 5,846,090 | A * | 12/1998 | Lu | H01R 39/64 | 439/26 |
| 7,740,484 | B1 * | 6/2010 | Chiang | H01R 24/76 | 439/13 |
| 9,281,648 | B2 * | 3/2016 | Pollner | H01R 39/643 | |
| 2003/0073333 | A1 * | 4/2003 | Matsumoto | H01R 39/64 | 439/164 |
| 2012/0220141 | A1 * | 8/2012 | Ickler | H01R 24/40 | 439/11 |
| 2015/0024610 | A1 * | 1/2015 | Pollner | H01R 39/643 | 439/28 |

* cited by examiner

*Primary Examiner* — Chandrika Prasad
(74) *Attorney, Agent, or Firm* — Kilpatrick Townsend & Stockton LLP

(57) ABSTRACT

A rotating contact device is described. The rotating contact device can include a contact ring and a pair of legs extending from a lower ring surface of the contact ring. Along an upper ring surface of the contact ring can be disposed one or more raised contacts. The rotating contact device can also include an inside contact held within an inside of the contact ring. Application of a downwards force on the upper ring surface of the contact ring causes the pair of legs to deflect and the contact ring and the inside contact to rotate and translate. When mated with opposing contacts, this rotation can function to radially wipe the opposing contacts and the upper ring surface.

20 Claims, 5 Drawing Sheets

ROTATING CONTACT RING WITH LEGS EXTENDING AT AN ANGLE TO A LOWER SURFACE OF THE RING

CROSS REFERENCE TO RELATED APPLICATION(S)

The present application claims the benefit of U.S. Provisional Application No. 62/235,508, filed Sep. 30, 2015, which is hereby incorporated by reference for all purposes.

FIELD

This disclosure relates to electrical contacts. In particular, electrical contacts that are used in connection with electronic devices.

BACKGROUND

Electrical contacts can be included in connectors and used to transfer power, data, and other signals between electronic devices and/or accessories. The electrical contacts within the connectors can be exposed to the environment in which the electronic devices are used, which can lead to a buildup of contaminants (e.g., oxides, oils, etc.) on surfaces of the electrical contacts. Because the contaminants can function to increase resistance of the electrical contacts, it is desirable to remove the contaminants prior to or as part of connecting to the electronic device. Wiping is a process in which two mating connectors "wipe" past each in a manner that removes at least some of the contaminants. For example, when a Uniform Serial Bus (USB) plug connector is installed in a USB port, metal contacts of the plug connector slide transversely across metal contacts in the port. This transverse wipe functions to remove contaminants from the metal contacts and improves the connection between the USB plug connector and the USB port.

However, in certain types of connectors, transverse wiping may not be an option for cleaning the contacts. This may be because of limits on the area surrounding the contacts. For example, connectors that use circular contacts that mate in a face-to-face orientation typically are not capable of transverse wiping. This can lead to poor connections between such connectors.

SUMMARY

Examples of the present disclosure are directed to rotating contacts for use in connecting electronic devices and/or accessories. These rotating contacts can be implemented to radially wipe opposing contacts in a face-to-face orientation and thus can be used to remove contaminants from the contacts in applications where transverse wiping is not possible or otherwise available. A particular rotating contact can include an annular or ring contact that has one or more contact surfaces formed along a upper surface. A pair of radially curved legs can be attached at a bottom surface of the annular contact. In some embodiments, within the inside of the contact ring is an inside contact that can be held in place by an insulative structure. The insulative structure also electrically isolates the inside contact from the contact ring. Opposing ends of the pair of legs can be fixed in a particular orientation. When an axial force that is normal to the upper surface is applied to the upper surface, the legs oppose the axial force and begin to deflect. This deflection lowers the contact ring and causes the inside contact and the contact ring to rotate. When the contact surfaces and the inside contact are engaging with opposing contacts (e.g., contacts mounted in a second electronic device), this rotation functions to radially wipe the opposing contacts, thereby improving the electrical connections between the contacts.

In some examples, a rotating contact device can include a contact having an upper ring surface, a lower ring surface, and a rotational axis. The rotating contact device can also include at least one contact surface disposed on the upper ring surface. The rotating contact device can also include a first leg and a second leg. The first leg can extend at a first predetermined angle from a first location on the lower ring surface. The second leg can extend at a second predetermined angle from a second location on the lower ring surface. The first leg and the second leg can be composed of deflectable material such that when an axial force is applied along the rotational axis of the contact ring, the first leg and the second leg oppose the axial force and apply a rotational force to the contact ring.

In some examples, a rotating contact system can include a housing and a rotating contact. The housing can include a cylindrical barrel and the rotating contact can be disposed in the cylindrical barrel. The rotating contact can include a contact ring having an upper ring surface, a lower ring surface, and a rotational axis. The rotating contact can also include at least one contact surface disposed on the upper ring surface. The rotating contact can also include a first leg and a second leg. The first leg can extend at a first predetermined angle from a first location on the lower ring surface. The second leg can extend at a second predetermined angle from a second location on the lower ring surface. The first leg and the second leg can be composed of deflectable material such that when an axial force is applied along the rotational axis of the contact ring, the first leg and the second leg oppose the axial force and apply a rotational force to the contact ring.

In some examples, an electronic device can include a housing and a connector disposed at an exterior surface of the housing. The connector can include a plurality of rotating contacts arranged in a pattern. Each rotating contact of the plurality of rotating contacts can include a contact having an upper contact surface, a lower surface, and a rotational axis. Each rotating contact can also include a first leg extending at a first angle from a first location on the lower surface. Each rotating contact can also include a second leg extending at a second angle from a second location on the lower surface. The first leg and the second leg can be composed of a deflectable material whereby when an axial force is applied along the rotational axis of the contact ring, each leg opposes the axial force and applies a rotational force to the contact.

To better understand the nature and advantages of the present disclosure, reference should be made to the following description and the accompanying figures. It is to be understood, however, that each of the figures is provided for the purpose of illustration only and is not intended as a definition of the limits of the scope of the present disclosure. Also, as a general rule, and unless it is evident to the contrary from the description, where elements in different figures use identical reference numbers, the elements are generally either identical or at least similar in function or purpose.

BRIEF DESCRIPTION OF THE DRAWINGS

The disclosure will be readily understood by the following detailed description in conjunction with the accompanying drawings, in which.

DETAILED DESCRIPTION

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the appended claims.

Figure 1A:
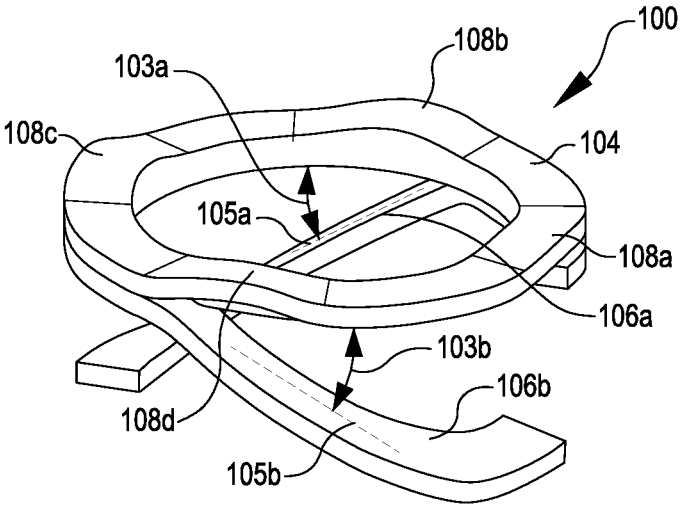
FIG. 1A shows an isometric view of a rotating contact, in accordance with at least one example.
Figure 1B:
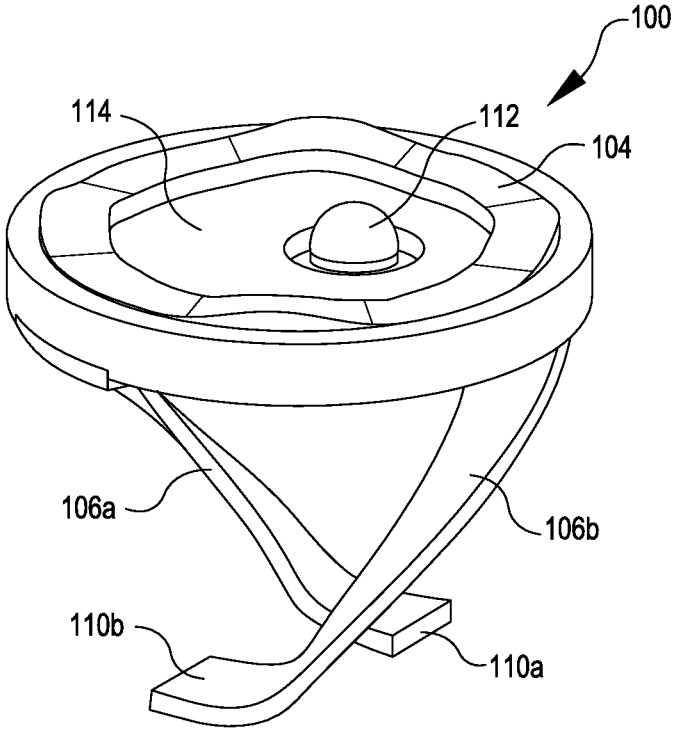
FIG. 1B shows an isometric view of the rotating contact of FIG. 1A including an insulative structure and an inside contact, in accordance with at least one example.

FIGS. 1A-1B illustrate a rotating contact 100 that can be included in a first electronic device, in accordance with at least one example of the disclosure. The rotating contact 100 can be used to create an electrical connection between the rotating contact 100 and an opposing contact, such as a circular contact 202 of an opposing contact 200 shown in FIG. 2, included in a second electronic device that is normal to the rotating contact 100 (i.e., aligned face-to-face with the rotating contact 100). During a connector mating event (e.g., when a connector having the rotating contact 100 is mated with a connector having the opposing contact 200), the rotating contact 100 creates an electrical connection with the opposing contact and also radially wipes the opposing contact 200 as it engages with the opposing contact 200. Such wiping can remove oxide layers, oils, and other contaminants that are present on the opposing contact and/or portions of the rotating contact 100 and improve the electrical connection between the rotating contact 100 and the opposing contact. Implementation of the rotating contact 100 in a face-to-face alignment achieves improved wipe, as compared to conventional contacts in a similar alignment that provide little or no wipe. Either contact 100 or 200 can be included in any type of electronic device such as, for example, smart phone, tablet, laptop computer, personal computer, docking station, camera, cable, keyboard, or any other suitable electronic device.

The rotating contact 100 includes an annular or contact ring 104 and a pair of contact beams or legs 106 (shown in FIG. 1 as legs 106*a*, 106*b*). The contact ring 104 can be pressed, stamped, cast, or otherwise formed as a single structure. Likewise, each leg 106 can be formed as a single structure and attached to the contact ring 104. In some examples, the rotating contact 100, including the contact ring 104 and the pair of legs 106, is formed as a single structure. In some examples, when the contact ring 104 and one or more of the legs 106 are separate structures, they can be welded, soldered, snap-fit, or otherwise attached together.

In some examples, the contact ring 114 can function as a power contact, a ground contact, a contact for control signals, a data contact for the transfer of data, or a contact for a variety of other signals. Therefore, the contact 114 can include any suitable lead (e.g., a flexible wire) to connect to an electrical system of an electronic device.

The contact ring 104 includes an upper ring surface including one or more raised contact surfaces 108 (shown in FIG. 1 as raised portions 108*a*-108*d*) disposed about the upper ring surface. The contact ring 104 also includes a lower ring surface with a depressed portion and a planar portion opposite the upper ring surface. In the example of FIGS. 1A and 1B, the raised contact surfaces 108 are ramped portions that are formed from the same piece of material as the contact ring 104. In some examples, the raised contact surfaces 108 are formed from different material than the contact ring 104. Because the surface area of the raised contact surfaces 108 is less than the total area of the upper surface of the contact ring 104, the contact pressure between the raised contact surfaces 108 and the opposing contact will be greater than if the raised contact surfaces 108 were not included. In this manner, a more effective wipe may be achieved as contact surface 108 rotates across a corresponding contact during a mating event. In some examples, the raised contact surfaces 108 (and any other rotating contacts) function to remove about 1 millimeter of contaminant material from the opposing contact. In some examples, the raised contact surfaces 108 function to remove about 0.1 millimeters of contaminant material.

Each leg 106 can have an elongated shape and be radially curved relative to the rotational axis that extends through the contact ring 104. Each leg 106 can be attached to a particular location on the lower ring surface of the contact ring 104 and extend away at a predetermined angle 103*a*, 103*b*. Each angle 103*a*, 103*b* extends between its respective axis 105*a*, 105*b* of the respective leg 106 and the planar portion of the lower ring surface. In some examples, the predetermined angle can be between 20-60 degrees. Each leg 106 can extend to a location below the contact ring 104. In some examples, the legs 106*a* and 106*b* can form a helical shape extending from the lower ring surface to the location below the contact ring 104. When the rotating contact 100 is included, for example, in a housing of an electronic device, terminal ends 110 of the legs 106 (shown in FIG. 1B as 110*a* and 110*b*) can be fixedly attached to the housing. In some examples, the terminal ends 110 are fixedly attached to a printed circuit board or some other electrical structure to which power, control signals, or data can flow via the contact ring 104 (and the legs 106). The terminal ends 110 can be fixedly attached at locations opposite from each other, or in any other suitable configuration.

The legs 106 can be formed from any suitable conductive material, which also has a relatively high yield strength and a relatively high modulus of elasticity. Thus, in some examples, the material can be considered a deflectable material or one that has elastic characteristics. Over the lifetime of the rotating contact 100, the legs 106 can be deflected thousands of times. A material with a high yield strength may enable suitable performance of the legs 106 over these thousands of deflections.

In some examples, the outer diameter of the contact ring 104 is less than 10 millimeters. In some examples, the outer diameter is about 6 millimeters. In some examples, the outer diameter is larger than or smaller than 10 millimeters. An inner radius for each of the mounting locations of the two terminal ends 110 can be less than an outer radius that corresponds to the outer diameter of the contact ring 104. In some examples, adjusting the inner radius compared to the outer radius affects the amount of rotation, i.e., radial wipe, of the contact ring 104. In some examples, the angle at which the legs 106 extend away from the contact ring 104 also impacts the amount of rotation of the contact ring 104.

As illustrated in FIG. 1B, the rotating contact 100 can also include an inside contact 112 held within an inside of the contact ring 104 by an insulative structure 114. The inside contact 112 can be offset from a center of the contact ring 104 so that when the rotating contact 100 rotates, the inside contact 112 will travel radially and function to wipe an opposing contact. Thus, the raised contact surfaces 108 and the inside contact 112 can function to wipe different individual contacts of an opposing contact structure. In some examples, the inside contact 112 can function as a power contact, a ground contact, a contact for control signals, a data contact for the transfer of data, or a variety of other contact types. Therefore, the inside contact 112 can include any suitable lead (e.g., a flexible wire) to connect to an electrical system. In some examples, more than one inside contact 112 can be provided in the rotating contact 100.

In some examples, the upper surface of contact 112 is shaped like a dome to enable increased pressure, and thus improved wiping, between contact 112 and its corresponding contact during mating event with another contact.

The insulative structure 114 can support the inside contact 112 and electrically isolate the inside contact from the contact ring 104. Insulative structure 114 can be formed using a variety of different methods from a variety of different materials having appropriate insulation properties. In various examples, insulative structure 114 can be made from polycarbonate, acrylonitrile butadiene styrene (ABS), nylon, glass-filled polymer, and any other suitable material having desired insulating properties. In some examples, structure 114 can be reflowed into the inside of the contact ring 104 after the contact ring 104 and the legs 106 have been formed. In some examples, the insulative structure 114 can function to retain the legs 106 in addition to the inside contact 112 and the contact ring 104.

In some examples, the rotating contact 100 can include a solid disk-shaped contact, instead of the inside contact 112 and the contact ring 104. The solid disk-shaped contact can be included in a first electronic device and configured to provide a single connection between the first electronic device and a second electronic device. To accommodate multiple single connections between the first electronic device and the second electronic device, other rotating contacts similar to the rotating contact 100 can be disposed in the first electronic device to mate with corresponding contact locations on the second electronic device.

In some examples, a plurality of rotating contacts 100 can be included in any suitable structure to form a connector. The connector can be included in an electronic device and/or an accessory device. For example, the connector can be disposed at an exterior surface of a housing of the electronic device. In some examples, the connector can be raised up relative to the exterior surface and can include any suitable structure to hold multiple rotating contacts 100 in any suitable pattern (e.g., a single line of n contacts, an n×m array of contacts, or other patterns). As an additional example, the connector can be recessed relative to the exterior surface and can include any suitable structure to hold multiple rotating contacts 100 in any suitable pattern. In some examples, the connector is about flush with the exterior surface of the housing. The connector can also include other contacts that are dissimilar to the rotating contacts 100 and can include structures that have functions other than transferring signals (e.g., physically supporting a second electronic device that is connected to the electronic device via the connector). In some examples, the plurality of rotating contacts 100 are arranged in any suitable pattern (e.g., one layer, multiple layers, etc.), whether within the connector or otherwise. The connectors can be used to transfer power, data, and other signals between electronic devices and/or accessory devices.

Figure 2:
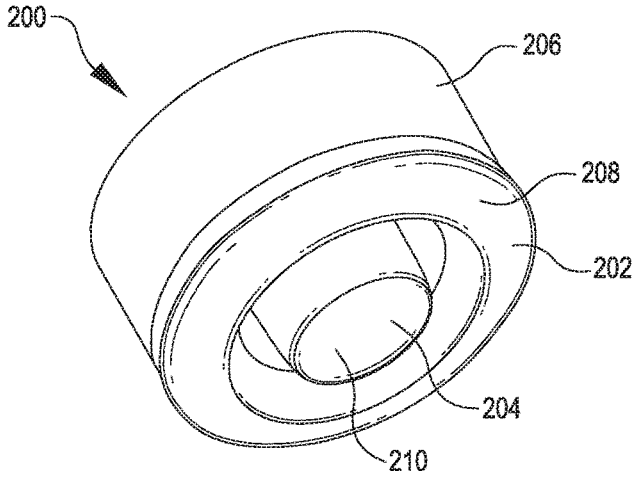
FIG. 2 shows an isometric view of an opposing contact, in accordance with at least one example.

FIG. 2 illustrates the opposing contact 200 that can be included in any suitable second electronic device and which can be paired with the rotating contact 100 included in any suitable first electronic device to create an electrical connection, in accordance with at least one example of the disclosure. The opposing contact 200 includes the circular contact 202 and an internal contact 204 located within the circular contact 202. The circular contact 202 and the internal contact 204 can be held by an insulative cap 206. In some examples, the insulative cap 206 functions to retain the circular contact 202 and the internal contact 204 and to electrically isolate the two contacts. The circular contact 202 extends radially around the opposing contact 200 in a donut shape. The internal contact 204 can be centered within the donut shape of the circular contact 202, or off center to allow radial wipe. The internal contact 204 can have a suitable surface 210 such that the inside contact 112 of the rotating contact 100 can engage with the internal contact 204. Similarly, the circular contact 202 can have a suitable surface 208 such that one or more of the raised contact surfaces 108 can engage with the circular contact 202. In some examples, the circular contact 202 can include one or more raised contact surfaces.

Figure 3:
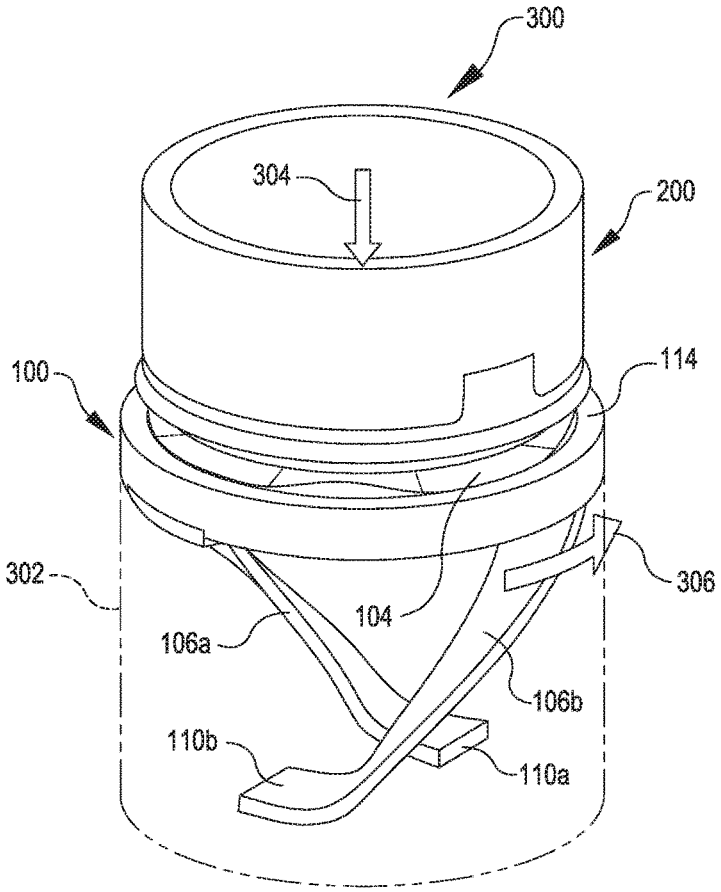
FIG. 3 shows an isometric view of the opposing contact of FIG. 2 mating with the rotating contact of FIG. 1B, in accordance with at least one example.

FIG. 3 illustrates a contact system 300 in accordance with at least one example of the disclosure. The contact system 300 includes the opposing contact 200 and the rotating contact 100 in a face-to-face orientation (i.e., the contacts of the opposing contact 200 are aligned with the contacts of the contact ring 104). In the contact system 300, the rotating contact 100 is disposed within in a cylindrical barrel 302. In some examples, the cylindrical barrel 302 may be formed in a housing of a first user device. The opposing contact 200 may be formed in a housing of a second user device that will be electrically connected to the first user device. The cylindrical barrel 302 may function to retain the translation of the contact ring 104 and the rotation of the contact ring 104. The insulative structure 114 can be sized to fit within the cylindrical barrel 302. In some examples, the interior surface of the barrel 302 and/or the exterior surface of the insulative structure 114 is coated, treated, or polished in order to reduce the friction between the two surfaces. In this manner, the contact ring 104 may move more freely within the cylindrical barrel 302. In some examples, a gasket is provided that is attached around the exterior surface of the insulative structure 114. The gasket can function to keep unwanted contaminants from entering the interior of the barrel 302. In some examples, the gasket can be water-tight. The terminal ends 110 can be fixedly held within the interior of the cylindrical barrel 302. In some examples, the terminal ends 110 are fixedly held in an orientation outside of the cylindrical barrel 302.

In practice, as an axial force 304 is applied to the opposing contact 200, the legs 106 begin to deflect or bend because the axial force 304 is transferred to the rotating contact 100 via the opposing contact 200. The axial force 304 can be a force applied as part of connecting the second electronic device to the first electronic device in which the rotating contact 100 is held. In some examples, the axial force 304 is a result of magnetic attraction between a part of the second electronic device and a part of the first electronic device (e.g., a portion of the housing). In any event, the axial force 304 and/or the deflection of the legs 106 causes the contact ring 104 to begin to rotate in the direction of arrow 306. Such rotation of the contact ring 104 causes the one or more raised contact surfaces 108 to radially wipe the surface 208 of the circular contact 202. Similarly, such rotation of the contact ring 104 causes the inside contact 112 to radially wipe the surface 210 of the internal contact 204.

In some examples, two or more rotating contacts 100 are included in a housing of a device. The two or more rotating contacts 100 can be included in an array (e.g., 2×2 or 4×4), a line, or in any other suitable pattern.

Figure 4A:
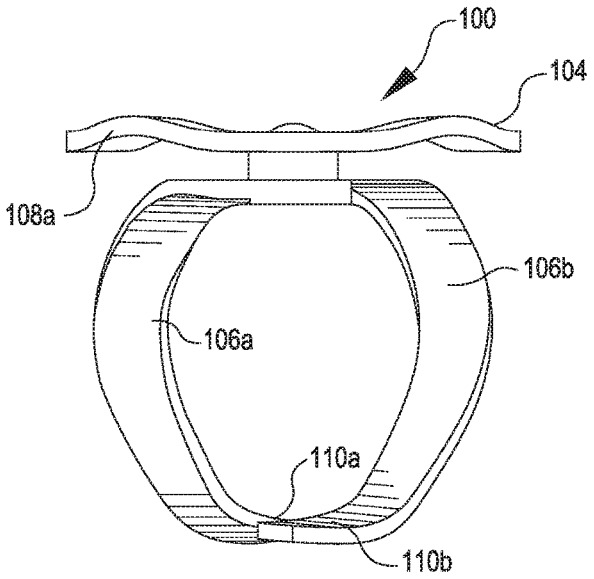
FIG. 4A show an isometric view of the rotating contact of FIG. 1B at a state of deflection and rotation, in accordance with at least one example.
Figure 4B:
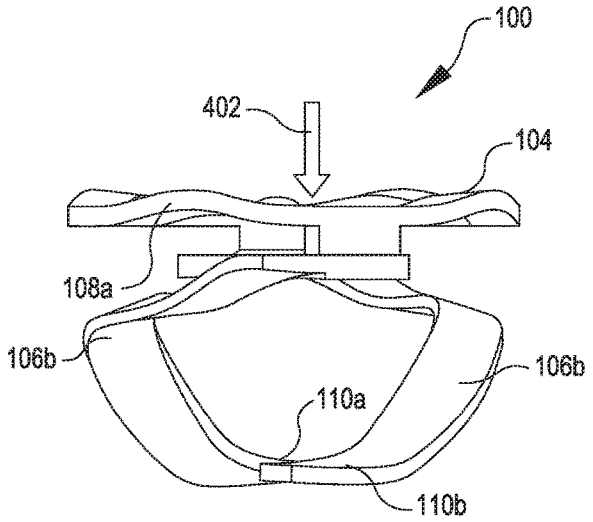
FIG. 4B show an isometric view of the rotating contact of FIG. 1B at another state of deflection and rotation, in accordance with at least one example.
Figure 4C:
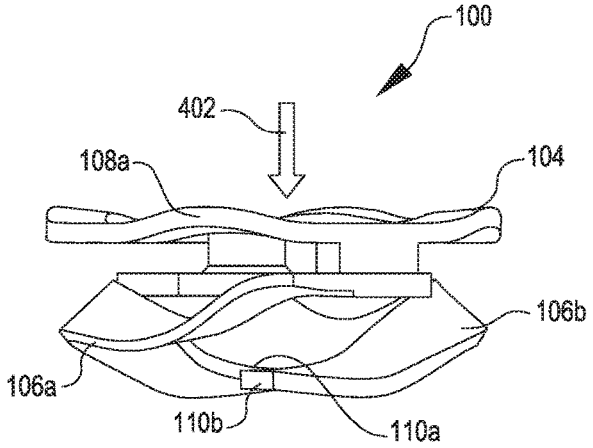
FIG. 4C show an isometric view of the rotating contact of FIG. 1B at another state of deflection and rotation, in accordance with at least one example.

FIGS. 4A-4C illustrate the rotating contact 100 at three different states of deflection and rotation, in accordance with at least one example of the disclosure. In particular, FIG. 4A illustrates the rotating contact 100 at an initial state before a force has been applied to the rotating contact 100. In the initial state, the legs 106 of the rotating contact 100 are fully extended and the contact ring 104 is at its furthest distance away from a bottom where the terminal ends 110 are held. In FIG. 4A, the raised contact surface 108*a* is identified as a rotational reference point.

FIG. 4B illustrates an intermediate state of the rotating contact 100. In between the initial state and the intermediate state, a force 402 began to be applied to the rotating contact 100. Thus, in the intermediate state in FIG. 4B, the legs 106 of the rotating contact 100 have begun to deflect. In particular, the legs have transitioned from fully-extended with a slight curve in FIG. 4A, to being partially-extending and having a much greater curved shape. The raised contact surface 108*a* in FIG. 4B has rotated to the right in the figure (i.e., counter-clockwise when looking down on the contact ring 104). Similarly, the contact ring 104 has translated down as the legs 106 have deflected.

FIG. 4C illustrates a final state of the rotating contact 100. The force 402 was continuously applied in between the intermediate state of FIG. 4B and the final state of FIG. 4C. Because of this, the legs 106 have continued to deflect down. In addition, the raised contact surface 108*a* has rotated further to the right. Similarly, the contact ring 104 has translated further down towards the terminal ends 110. In some examples, the translation of the contact ring 104 between the initial state and final state is between 2-3 millimeters. In some examples, the rotation of the raised contact surface 108*a* between the initial state and the final state amounts to about 0.6 millimeters of radial wipe. In other examples, the amount of translation and the rotation is greater than or less than 2-3 millimeters and 0.6 millimeters, respectively. Thus, the rotating contact 100 can be scaled up, depending on the implementation, or scaled down.

Figure 5A:
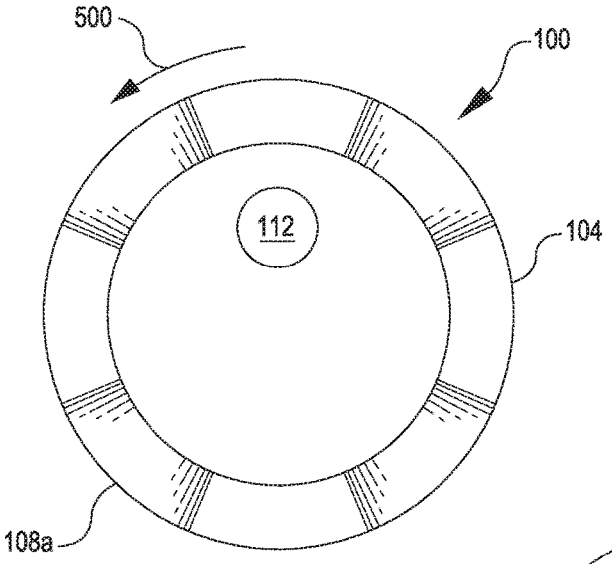
FIG. 5A shows a top view of the rotating contact of FIG. 1B at a state of rotation, in accordance with at least one example.
Figure 5B:
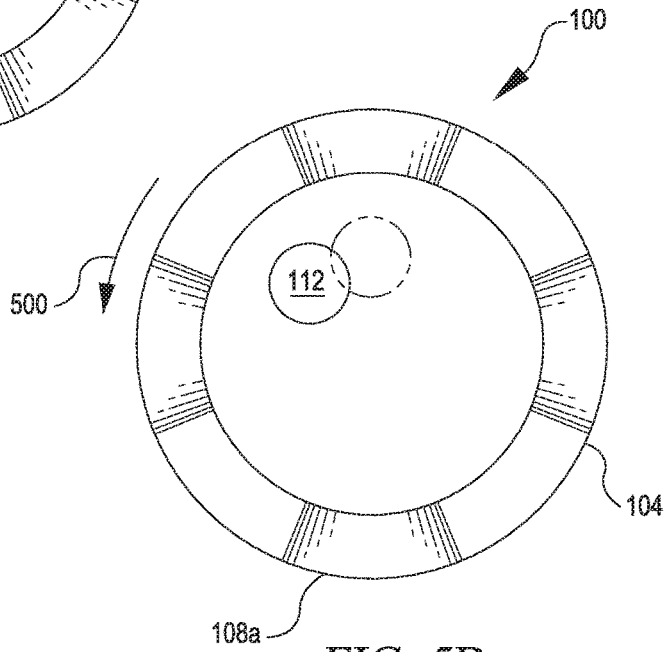
FIG. 5B shows a top view of the rotating contact of FIG. 1B at another state of rotation, in accordance with at least one example.
Figure 5C:
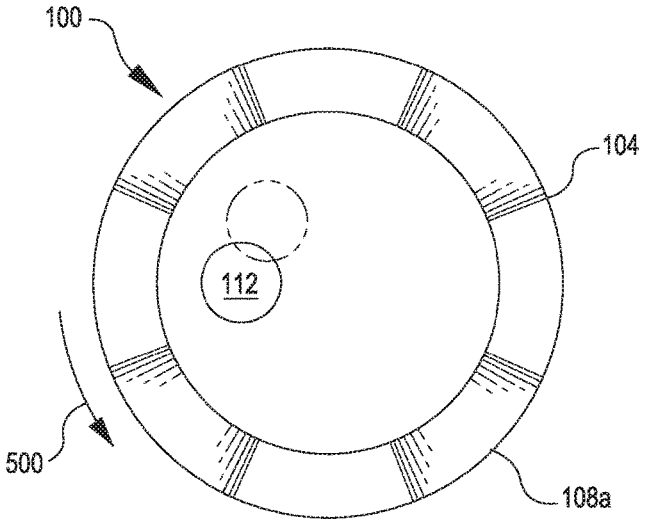
FIG. 5C shows a top view of the rotating contact of FIG. 1B at another state of rotation, in accordance with at least one example.

FIGS. 5A-5C illustrate a top view of the rotating contact 100 at three different states of rotation, in accordance with at least one example of the disclosure. In particular, FIG. 5A illustrates the rotating contact 100 at an initial state. The initial state illustrated in FIG. 5A corresponds to the initial state illustrated in FIG. 4A. In FIG. 5A, the contact ring 104 and the inside contact 112 are illustrated, and the raised contact surface 108*a* and the inside contact 112 are identified as rotational reference points. At the initial state illustrated in FIG. 5A, the rotating contact 100 has not yet been mated with an opposing contact.

FIG. 5B illustrates an intermediate state of the rotating contact 100. The intermediate state illustrated in FIG. 5B corresponds to the intermediate state illustrated in FIG. 4B. In FIG. 5B, the rotating contact 100 has rotated in a counter-clockwise direction 500 as compared to the state illustrated in FIG. 5A. This can be evidenced by the inside contact 112 rotating slightly to the left and the raised contact surface 108*a* rotating slightly down and to the right between FIGS. 5A and 5B. The rotating contact 100 may rotate in response to an axial force being applied to the rotating contact 100 as part of mating the rotating contact 100 with an opposing contact (not shown).

FIG. 5C illustrates a final state of the rotating contact 100. The final state illustrated in FIG. 5C corresponds to the final state illustrated in FIG. 4C. In FIG. 5C, the rotating contact 100 has continued to rotate in the counter-clockwise direction 500 as compared to the state illustrated in FIG. 5B. This can be evidenced by the inside contact 112 rotating slightly down and to the left and the raised contact surface 108*a* rotating slightly to the right and up between FIGS. 5B and 5C.

In some examples, the rotating contact 100 and its elements (e.g., the ring contact 104 and the inside contact 112) may rotate through a rotation angle of about 5-25 degrees between the initial state illustrated in FIG. 5A and the final state illustrated in FIG. 5C. Thus, it should be appreciated that the movement of the rotating contact 100 in FIGS. 5A-5C has been exaggerated for illustrative purposes. In other examples, however, the rotation angle is greater than or less than 5-25 degrees. For example, the rotation angle can be closer to 90 degrees. In any event, the rotating contact 100 can be scaled up, depending on the implementation, or scaled down, which can affect the rotation angle, among other things. In some examples, the value of the rotation angle can depend on the length of the legs 106, the alignment of the legs 106, the curvature of the legs 106, the material used to form the legs 106, the diameter of the ring contact 104 as compared to a diameter defined by the terminal ends 110 of the legs 106, and any other suitable characteristic of the rotating contact 100. In some examples, the rotating contact 100 can rotate in a clockwise direction (e.g., opposite the direction 500).

Figure 6:
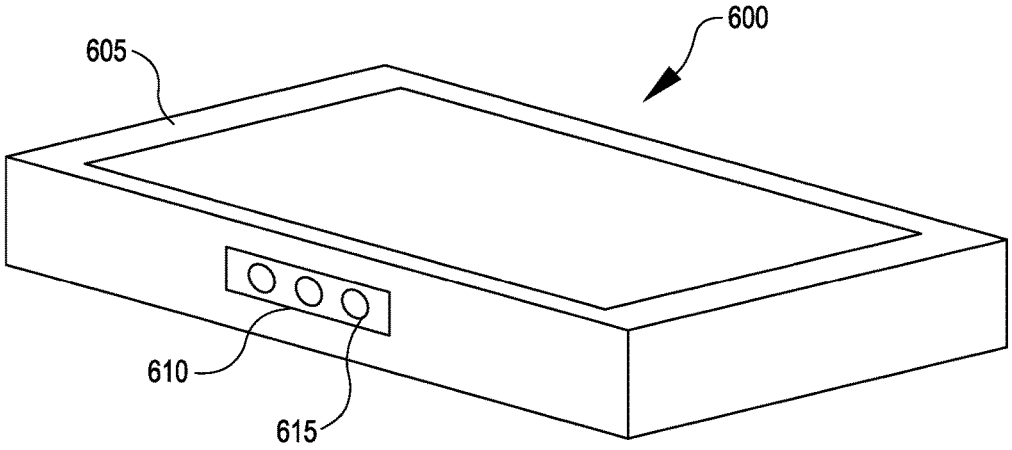
FIG. 6 shows a perspective view of an electronic device including a connector, in accordance with at least one example.

FIG. 6 illustrates an electronic device 600 that includes a housing 605 and a connector 610 disposed at an exterior surface of the housing 605. Connector 610 can include multiple rotating contacts 615 arranged in a pattern. As described above with respect to FIG. 1A, each individual rotating contact 615 can include an upper contact surface, a lower surface, and a rotational axis. Each rotating contact 615 can also include a first leg extending at a first angle from a first location on the lower surface, and a second leg extending at a second angle from a second location on the lower surface. The first leg and the second leg can be composed of a deflectable material whereby when an axial force is applied along the rotational axis of the contact ring, each leg opposes the axial force and applies a rotational force to the contact.

Spatially relative terms, such as "below", "above", "lower", "upper" and the like may be used above to describe an element and/or feature's relationship to another element(s) and/or feature(s) as, for example, illustrated in the figures. It will be understood that the spatially relative terms are intended to encompass different orientations of the device in use and/or operation in addition to the orientation depicted in the figures. For example, if the device in the figures is turned over, elements described as "below" and/or "beneath" other elements or features would then be oriented "above" the other elements or features. The device may be otherwise oriented (e.g., rotated 90 degrees or at other orientations) and the spatially relative descriptors used herein interpreted accordingly.

The above description of embodiments of the disclosure has been presented for the purposes of illustration and description. It is not intended to be exhaustive or to limit the disclosure to the precise form described, and many modifications and variations are possible in light of the teaching above. For example, while rotating contact 100 was described above as having a contact ring, in some embodiments rotating contact 100 includes a solid disk-shaped contact that does not include a central opening. The embodiments set forth above were chosen and described in order to best explain the principles of the disclosure and its practical applications to thereby enable others skilled in the art to best utilize the disclosure in various embodiments and with various modifications as are suited to the particular use contemplated. Thus, it will be appreciated that the disclosure is intended to cover all modifications and equivalents within the scope of the following claim.

What is claimed is:

1. A rotating contact device, comprising:

a contact ring having an upper ring surface, a lower ring surface, and a rotational axis;

at least one contact surface defined on the upper ring surface;

a first leg extending at a first predetermined angle from a first location on the lower ring surface; and a second leg extending at a second predetermined angle from a second location on the lower ring surface, each of the first leg and the second leg composed of a deflectable material whereby when an axial force is applied along the rotational axis of the contact ring, each leg opposes the axial force and applies a rotational force to the contact ring.

2. The rotating contact device of claim 1, wherein each of the first leg and the second leg is curved relative to the rotational axis.

3. The rotating contact device of claim 1, wherein:

the first predetermined angle is defined between a first axis of the first leg and the lower ring surface;

the second predetermined angle is defined between a second axis of the second leg and the lower ring surface; and each of the first predetermined angle and the second predetermined angle is between 20 degrees and 60 degrees.

4. The rotating contact device of claim 1, wherein the axial force, when applied, causes the contact ring to rotate about the rotational axis and to translate in the direction of the axial force.

5. The rotating contact device of claim 1, further comprising:

an insulative structure disposed within an inside area of the contact ring; and an inside contact held by the insulative structure within the inside area, the inside contact being electrically isolated from the contact ring.

6. The rotating contact device of claim 5, wherein the rotational axis extends through a center point of the contact ring, and wherein the inside contact is offset from the center point.

7. The rotating contact device of claim 1, wherein the rotating contact device is disposed within a cylindrical barrel, the cylindrical barrel configured to:

retain the contact ring when the contact ring rotates about the rotational axis; and retain the first leg and the second leg as the first leg and the second leg oppose the axial force.

8. The rotating contact device of claim 1, wherein the at least one contact surface is a raised contact surface.

9. A rotating contact system, comprising:

a housing comprising a cylindrical barrel; and a rotating contact disposed within the cylindrical barrel, the rotating contact comprising:

a contact ring having an upper ring surface, a lower ring surface, and a rotational axis;

at least one contact surface defined on the upper ring surface;

a first leg extending at a first predetermined angle from a first location on the lower ring surface; and a second leg extending at a second predetermined angle from a second location on the lower ring surface, each of the first leg and the second leg composed of a deflectable material whereby when an axial force is applied along the rotational axis of the ring contact, each leg opposes the axial force and applies a rotational force to the contact ring.

10. The rotating contact system of claim 9, wherein the rotational force causes the at least one contact surface to radially wipe an opposing contact surface of an opposing contact.

11. The rotating contact system of claim 9, wherein the axial force, when applied, causes the contact ring to rotate about the rotational axis within the cylindrical barrel and to translate in the direction of the axial force within the cylindrical barrel.

12. The rotating contact system of claim 9, wherein each of the first leg and the second leg is curved relative to the rotational axis.

13. The rotating contact system of claim 9, wherein the rotational axis extends through a center point of the contact ring, and the rotating contact includes a contact.

14. The rotating contact system of claim 9, wherein the rotating contact is a first rotating contact and the cylindrical barrel is a first cylindrical barrel, and wherein the housing comprises a connector disposed along an exterior surface of the housing, the connector comprising:

the first rotating contact disposed within the first cylindrical barrel; and a second rotating contact disposed within a second cylindrical barrel.

15. The rotating contact system of claim 14, wherein the housing is a housing of a first electronic device, and wherein the connector is configured to mate with a corresponding connector of a second electronic device.

16. The rotating contact system of claim 15, wherein the first electronic device is configured to transfer one or more power signals, data signals, or control signals between the second electronic device and the first electronic device via the connector and the corresponding connector.

17. An electronic device, comprising:

a housing; and a connector disposed at an exterior surface of the housing, the connector comprising:

a plurality of rotating contacts arranged in a pattern, each rotating contact of the plurality of rotating contacts comprising:

a contact having an upper contact surface, a lower surface, and a rotational axis;

a first leg extending at a first angle from a first location on the lower surface; and a second leg extending at a second angle from a second location on the lower surface, each of the first leg and the second leg composed of a deflectable material whereby when an axial force is applied along the rotational axis of the contact, each leg opposes the axial force and applies a rotational force to the contact.

18. The electronic device of claim 17, wherein, for at least one rotating contact of the plurality of rotating contacts, the contact is a solid disk-shaped contact.

19. The electronic device of claim 17, wherein the connector further comprises a plurality of cylindrical barrels dimensioned to receive the plurality of rotating contacts.

20. The electronic device of claim 19, wherein the axial force, when applied, causes, for each rotating contact, the contact to rotate about the rotational axis within the cylindrical barrel and to translate in the direction of the axial force within the cylindrical barrel.

* * * * *